US006345900B2

(12) United States Patent
Maglica

(10) Patent No.: US 6,345,900 B2
(45) **Date of Patent: *Feb. 12, 2002**

(54) TAILCAP AND BULB HOLDER FOR A FLASHLIGHT

(75) Inventor: Anthony Maglica, Anaheim, CA (US)

(73) Assignee: Mag Instrument, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/747,199

(22) Filed: Dec. 22, 2000

Related U.S. Application Data

(63) Continuation of application No. 09/241,944, filed on Feb. 2, 1999, now Pat. No. 6,193,389, which is a division of application No. 08/695,371, filed on Aug. 9, 1996, now Pat. No. 5,865,526, which is a continuation of application No. 08/382,289, filed on Feb. 1, 1995, now Pat. No. 5,548,495, which is a division of application No. 08/243,471, filed on May 16, 1994, now Pat. No. 5,390,091, which is a continuation of application No. 08/091,071, filed on Jul. 13, 1993, now Pat. No. 5,315,494, which is a continuation-in-part of application No. 07/866,714, filed on Apr. 10, 1992, now Pat. No. 5,226,722.

(51) Int. Cl.[7] ..... F21L 7/00
(52) U.S. Cl. ..... 362/207; 362/202
(58) Field of Search ..... 362/202, 205, 362/207, 208

(56) References Cited

U.S. PATENT DOCUMENTS

| | | | | |
|---|---|---|---|---|
| 2,231,382 A | * | 2/1941 | Desimone | 362/207 |
| 4,286,311 A | | 8/1981 | Maglica | 362/205 |
| 4,325,107 A | | 4/1982 | MacLeod | 362/207 X |
| 4,375,262 A | | 3/1983 | Maglica | 206/592 X |
| 4,388,673 A | | 6/1983 | Maglica | 362/183 |
| 4,527,223 A | | 7/1985 | Maglica | 362/187 |
| 4,577,263 A | | 3/1986 | Maglica | 362/187 |
| 4,658,336 A | | 4/1987 | Maglica | 362/205 X |
| 4,899,265 A | | 2/1990 | Maglica | 362/187 |
| 4,942,505 A | | 7/1990 | Maglica | 362/205 X |
| 5,113,326 A | | 5/1992 | Maglica | 362/205 X |
| 5,226,722 A | | 7/1993 | Maglica | 362/207 |
| 5,315,494 A | | 5/1994 | Maglica | 362/207 |
| 5,390,091 A | | 2/1995 | Maglica | 362/207 |
| 5,548,495 A | | 8/1996 | Maglica | 362/207 |
| 5,722,765 A | * | 3/1998 | Maglica | 362/207 |
| 5,833,354 A | * | 11/1998 | Maglica | 362/207 |
| 5,865,526 A | | 2/1999 | Maglica | 362/207 |
| 6,193,389 B1 | * | 2/2001 | Maglica | 362/207 |

* cited by examiner

*Primary Examiner*—Stephen Husar
(74) *Attorney, Agent, or Firm*—Lyon & Lyon LLP

(57) ABSTRACT

A flashlight having a head assembly, a switch assembly and a removable tail cap with a spare bulb holder provided by the tail cap. The spare bulb holder includes a resilient body having an internal, U-shaped wall defining a slot configured to receive a flashlight bulb, a cylindrical wall about the slot and ribs extending between the U-shaped wall and the cylindrical peripheral wall. The slot extends through the cylindrical peripheral wall and includes a first section for receiving the plug of a flashlight bulb, a second section for receiving the flange of a flashlight bulb and a third section for receiving a lens of the flashlight bulb.

8 Claims, 3 Drawing Sheets

TAILCAP AND BULB HOLDER FOR A FLASHLIGHT

This is a continuation of U.S. patent application Ser. No. 09/241,944, filed Feb. 2, 1999, issued as U.S. Pat. No. 6,193,389, which is a divisional of U.S. patent application Ser. No. 08/695,371, filed Aug. 9, 1996, issued as U.S. Pat. No. 5,865,526, on Feb. 2, 1999, which is a continuation of U.S. patent application Ser. No. 08/382,289, filed Feb. 1, 1995, issuing as U.S. Pat. No. 5,548,495 on Aug. 20, 1996, which is a division of U.S. patent application Ser. No. 08/243,471, filed May 16, 1994, issued as U.S. Pat. No. 5,390,091, which is a continuation of U.S. patent Ser. No. 08/091,071, filed Jul. 13, 1993, issued as U.S. Pat. No. 5,315,494, which is a continuation-in-part of U.S. patent application Ser. No. 07/866,714, filed Apr. 10, 1992, issued as U.S. Pat. No. 5,226,722, the disclosures of which are incorporated herein by reference.

BACKGROUND OF THE INVENTION

The field of the present invention is flashlights.

Flashlights are frequently designed for rugged use. However, in spite of the overall rugged nature of devices so designed, each, by their very nature, employs a light bulb. The bulbs used vary in construction; but all use a thin filament as a means for physically generating light. In spite of all possible mounting means for such filaments or for the bulb itself, the filaments are subject to being broken by shock loading. This has been observed even without damage to the flashlight itself. Therefore, the filament typically is the most fragile element in such ruggedly designed flashlights. Furthermore, filaments have been found more susceptible to breakage when hot, i.e., when the flashlight is on.

To mitigate the difficulties associated with the fragile nature of bulb filaments, flashlights have been equipped with spare bulbs. As a spare bulb may be more resiliently mounted and remain in a cold state, it is far less likely to be damaged or broken than a bulb in use. One such design is found in U.S. Pat. No. 4,286,311, the disclosure of which is incorporated herein by reference. The tail cap is hollowed out to receive an extra bulb sandwiched between two pads of sponge rubber or the like. This is indicated to be for the purpose of preventing breakage of the spare bulb in the event the flashlight should be dropped or struck a heavy blow. Another such arrangement is illustrated in U.S. Pat. No. 4,527,223, the disclosure of which is incorporated herein by reference. Again, a spare bulb is accommodated within a tail cap assembly where it is protected by a piece of resilient material. A spare bulb is housed within a tail cap between two pads in U.S. Pat. No. 4,388,673, the disclosure of which is incorporated herein by reference. In U.S. Pat. No. 4,577,263, a miniature bulb having contact pins rather than a plug is located within a bore in a tail cap assembly, the disclosure of which is also incorporated herein by reference.

Of particular interest are flashlights such as certain of those disclosed in the aforementioned patents which are used by emergency services such as police and fire departments. These flashlights must be rugged and very reliable. Such users place themselves in harms way which, by definition, includes very adverse environmental conditions and shock loadings. Having an available, undamaged spare bulb could mean the difference between life and death.

In providing for a protective spare bulb mounting, it is advantageous to provide against shock loading and provide for fixed but resilient placement and easy access. Additionally, it is advantageous to create a mounting which admits of easy assembly while assuring secure retention of the bulb. Further, for replacement by users of such flashlights, it is advantageous to have a specific mounting position such that a replacement spare bulb may be positioned appropriately and securely with relative ease.

Users are unlikely to check the spare bulb until needed. Insuring a proper positioning and secure yet resilient retention of the bulb creates flashlight reliability desired for a true emergency device.

SUMMARY OF THE INVENTION

The present invention is directed to a tailcap for a flashlight which includes a cap with an open cavity therein, a bulb holder, a flashlight bulb and a circular seal associated with the cap. The holder closely fits within the cavity and includes a cylindrical resilient body with the slot for receiving the flashlight bulb. The slot extends across the body and receives the bulb in interference fit. Ribs extend across the body outwardly of the slot. Other features may be added to the tailcap such as an annular channel to receive a one-way seal and a spring seat for receiving a flashlight spring.

Accordingly, it is an object of the present invention to provide an improved tailcap for a flashlight with a spare bulb retaining structure. Further objects and advantages will appear hereinafter.

DETAILED DESCRIPTION OF THE PREFERRED EMBODIMENT

Figure 1:
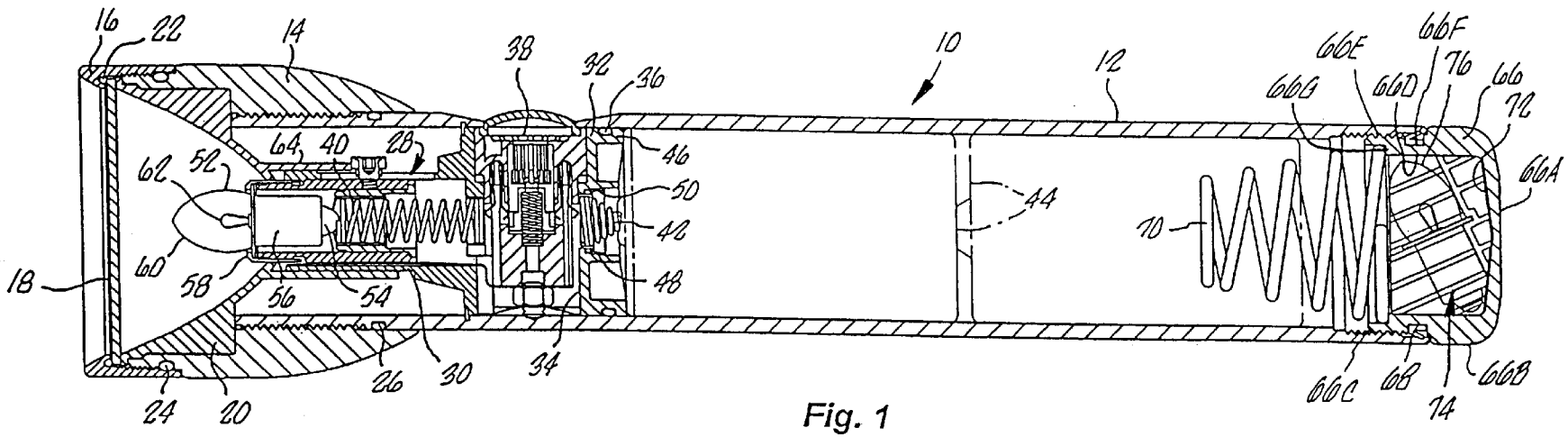
FIG. 1 is a cross-sectional view of a flashlight.
Figure 3:
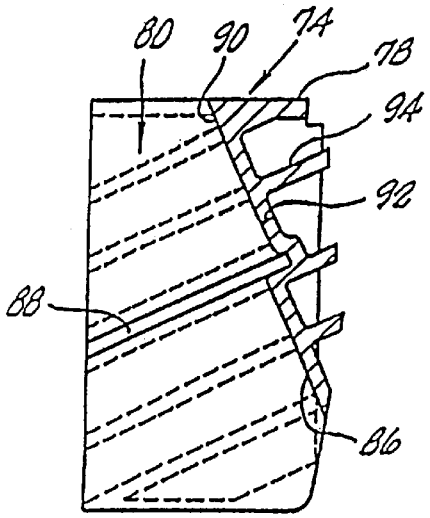
FIG. 3 is a cross-sectional view taken along line 3—3 of FIG. 2.
Figure 2:
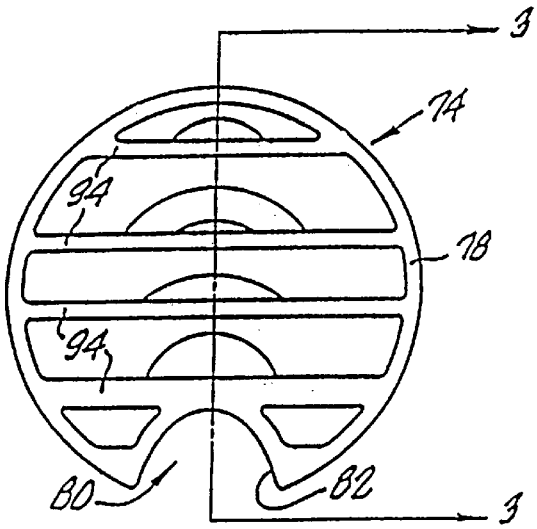
FIG. 2 is a bottom view of a bulb holder of a first embodiment.
Figure 4:
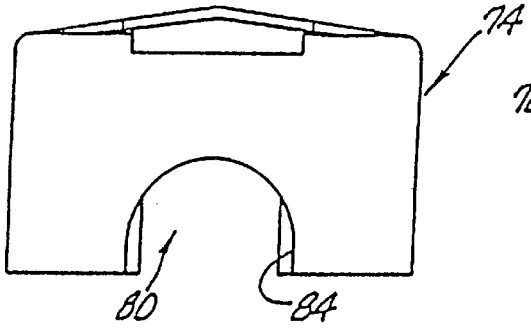
FIG. 4 is a side view of the holder.
Figure 5:
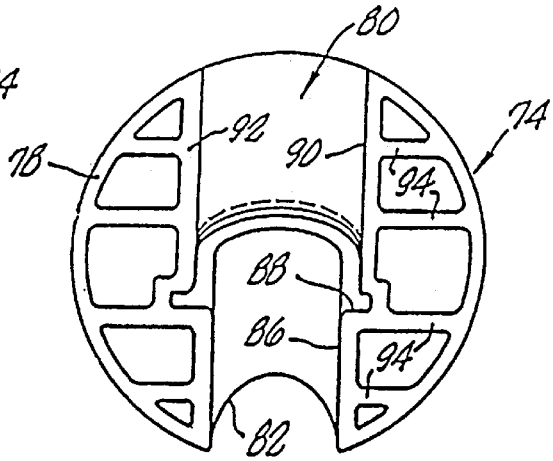
FIG. 5 is a plan view of the holder.
Figure 6:
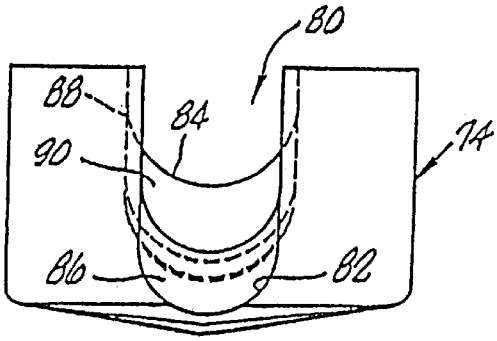
FIG. 6 is a side view of the holder opposite to that of FIG. 4.
Figure 7:
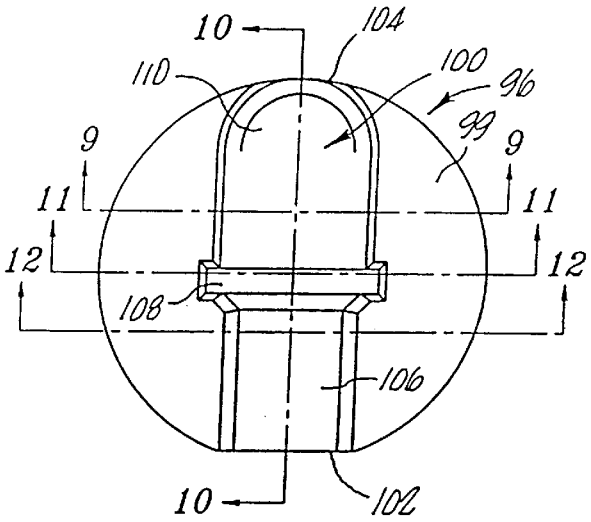
FIG. 7 is a plan view of a bulb holder of a second embodiment.
Figure 8:
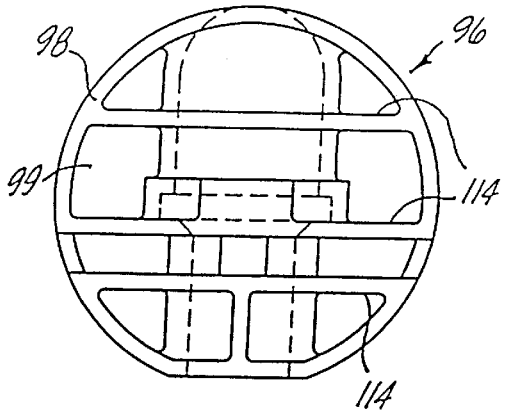
FIG. 8 is a bottom view of the holder.
Figure 9:
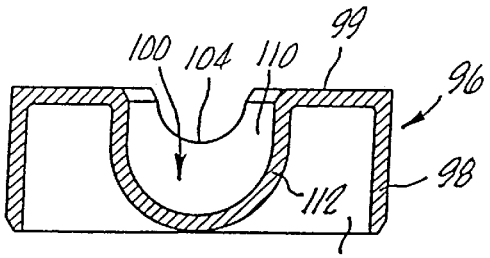
FIG. 9 is a cross-sectional view taken along line 9—9 of FIG. 7.
Figure 10:
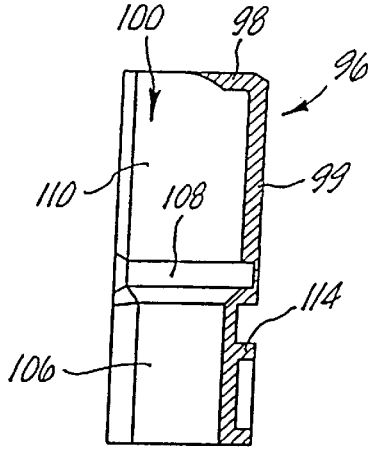
FIG. 10 is a cross-sectional view taken along line 10—10 of FIG. 7.
Figure 11:
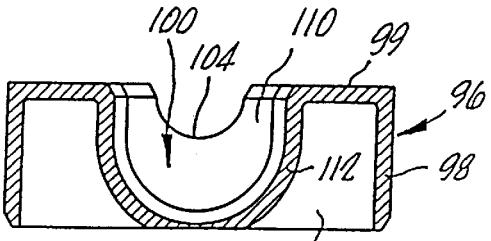
FIG. 11 is a cross-sectional view taken along line 11—11 of FIG. 7.
Figure 12:
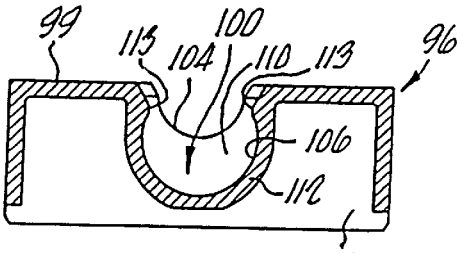
FIG. 12 is a cross-sectional view taken along line 12—12 of FIG. 7.

Turning in detail to the drawings, as shown in FIG. 1, the present flashlight 10 has a barrel 12 having an externally threaded forward, or front, end and an internally threaded back, or rear, end. A head 14 is threaded on the front end of the barrel 12. A face cap 16 is threaded onto the head 14. A lens 18, which may be clear or colored, is held in place between the face cap 16 and a reflector 20. A face cap O-ring 22 positioned in a recess in the face cap 16 provides a resilient contact between the face cap 16 and the lens 18. A head O-ring 24 seals the face cap 16 against the head 14. A barrel O-ring 26 rotatably seals the head 14 against the outside of the barrel 12.

A switch housing 28 has a neck 30 and a cylindrical body 32. A bore 34 extends through the cylindrical body 32 substantially perpendicular to the center line of the cylindrical body 32. The neck 30 is aligned along the center line of the cylindrical body 32. An O-ring slot 36 is provided at the rear end of the switch housing 28. A switch 38 is located within the bore 34 and provides contact between a spring 40 extending into the neck 30 and a contact spring 42 extending to the positive terminal of a battery 44, illustrated in phantom. The rear of the cylindrical body 32 includes a shoulder 46 against which the forward battery 44 may rest. This shoulder 46 regulates the maximum amount of contact pressure against the contact spring 42 by the positive terminal of the battery 44. Also at the rear of the cylindrical body 32 about the contact spring 42 is an O-ring 48 associated with a contact plate 50. The O-rings 36 and 48 seal the forward end of the battery case defined by the barrel 12 to ensure that no corrosive materials from the battery case can reach the switch 38.

The reflector 20 includes a central opening for receipt of the flashlight bulb 52. The bulb 52 includes a rear contact 54, a plug 56, a plug flange 58, a bulbous lens 60 and a filament 62 as is conventional with flashlight bulbs. A rearwardly extending cylinder 64 on the reflector 20 receives the neck 30.

Looking to the rear of the flashlight 10, a tail cap 66 is threadably associated with the barrel 12 to close the end of the battery case. In this embodiment, the barrel 12 is internally threaded while the tail cap is externally threaded. The tailcap 66 is a cap including an end wall 66A, a cylindrical side wall 66B having an open rim 66C to define an open cavity 66D. External threads 66E are located adjacent the edge of the rim 66C. An annular channel 66F is positioned to receive a circular seal. A spring seat 66G is located about the interior wall of the cylindrical sidewall 66B. A lip seal 68 is arranged for one-way flow of gas from the barrel 12. Positioned on a seat on the inner end of the tail cap 66 is a contact spring 70 which is compressed against the negative terminal of the rearmost battery 44, illustrated in phantom.

The tail cap 66 is hollow, defining a cylindrical cavity 72 open inwardly toward the barrel 12. A resilient body, generally designated 74 (96), is closely fit within the cylinder 72 to form, with the tail cap 66, a spare bulb holder. A spare flashlight bulb 76 is illustrated in position within the holder.

Looking more specifically at the resilient body 74 of the first embodiment, reference is made to FIGS. 2 through 6. The resilient body 74 is generally cylindrical in shape as defined by a cylindrical peripheral wall 78. As indicated above, the resilient body 74 fits closely within the cylindrical cavity 72 and the tail cap 66. With a bulb 76 in position, it is preferred that the cylindrical peripheral wall 78 comes into interference fit with the tail cap 66 such that the resilient body 74 is not free to move within the tail cap 66 and the bulb is not easily extracted from the resilient body 74 without first removal of the body 74 with the bulb 76 in place from the cylinder cavity 72.

Extending across one end of the peripheral wall 78 is an end wall 92. Defined in the end wall 92 and within the cylindrical peripheral wall 78 is a slot, generally designated 80. The slot 80 extends to intersect and open through the cylindrical peripheral wall 78 at each end, defining U-shaped openings 82 and 84 through the cylindrical peripheral wall 78. The slot 80 defines a first section 86 which is U-shaped in cross section and is of a first width. A second section 88 is also U-shaped in cross section and is relatively short but wider than the first section. A third section 90 is wider than the first section but not so wide as the second section. These three sections 86, 88 and 90 are arranged to receive the spare flashlight bulb 76 such that is the first section 86 receives the plug portion of the bulb 76, the second section 88 receives the plug flange and the third section 90 receives the lens of the bulb 76. Defining the slot 80 is a wall 92 which is U-shaped in cross section. The slot 80 is inclined as can best be seen in the figures. The slot 80 receives the spare bulb 76 with interference fit. Because of the resilience of the body 74, the bulb is easily accommodated but securely retained. The interference fit may be made with any or all of the plug, the plug flange and the lens.

Extending outwardly from the wall 92 defining the slot 80 to the cylindrical peripheral wall 78 are ribs 94. The ribs provide location for the slot 80 and yet provide very substantial resilience and energy absorption not provided by a solid body. The ribs are conveniently substantially parallel and extend in planes normal to the center line of the slot as does the second section as can best be seen in FIG. 3.

Looking to the second embodiment of the resilient body 96, reference is made to FIGS. 7 through 12. The resilient body 96 is generally cylindrical in shape as defined by a cylindrical peripheral wall 98. As indicated above, the resilient body 96 fits closely within the cylindrical cavity 72 and the tail cap 66. With a bulb 76 in position, it is preferred that the cylindrical peripheral wall 98 comes into interference fit with the tail cap 66 such that the resilient body 96 is not free to move within the tail cap 66 and the bulb is not easily extracted from the resilient body 96 without first removal of the body 96 with the bulb 76 in place from the cylinder cavity 72.

Defined within the cylindrical peripheral wall 98 is a slot, generally designated 100. The slot 100 extends to intersect and open through the cylindrical peripheral wall 98 at each end, defining U-shaped openings 102 and 104 through the cylindrical peripheral wall 98. The slot 100 defines a first section 106 which is U-shaped in cross section and is of a first width. A second section 108 is also U-shaped in cross section and is relatively short but wider than the first section. A third section 110 is wider than the first section but not so wide as the second section. These three sections 106, 108 and 110 are arranged to receive the spare flashlight bulb 76 such that the first section 106 receives the plug portion of the bulb 76, the second section 108 receives the plug flange and the third section 110 receives the lens of the bulb 76. Defining the slot 100 is a wall 112 which is U-shaped in cross section. The slot 100 receives the spare bulb 76 with interference fit. In the region of the first section 106 of the slot 100 receiving the bulb plug portion, a ridge 113 parallel to the axis of the slot 110 is found on both sides of the slot. The ridges 113 are inwardly in the slot 100 of tapered portions to accommodate initial placement of the bulb prior to it being forced into the slot 100. Because of the resilience of the body 96, the bulb is easily accommodated but securely retained, particularly at the plug portion of the slot 100 by the ridges 113. The interference fit may be made with any or all of the plug, the plug flange and the lens.

Extending outwardly from the wall 112 defining the slot 100 to the cylindrical peripheral wall 98 are ribs 114. The ribs provide location for the slot 100 and yet provide very substantial resilience and energy absorption not provided by a solid body. The ribs 114 are conveniently substantially parallel and extend in planes normal to the center line of the slot as does the second section.

Accordingly, an improved flashlight bulb holder is defined in association with a flashlight. While embodiments and applications of this invention have been shown and described, it would be apparent to those skilled in the art that many modifications are possible without departing from the inventive concepts herein. The invention, therefore, is not to be restricted except in the spirit of the appended claims.

What is claimed is:

1. A tail cap for a flashlight, comprising:

a cap including an end wall, a cylindrical side wall having a rim and extending from the end wall to the rim, an open cavity defined by the end wall and the side wall, external threads about the rim and an annular channel adjacent the external threads;

a flashlight bulb having a plug, a bulbous lens and a flange between the plug and the bulbous lens;

a circular seal in the annular channel;

a resilient cylindrical body positionable within said cap to fit closely therein, said body including a slot to receive a flashlight bulb, the slot being inclined from a plane normal to any center line of the resilient cylindrical body and extending across said resilient body and sized to receive the flashlight bulb in interference fit, the slot having a first section to receive the flashlight bulb plug, a second section to receive the flashlight bulb plug flange and a third section to receive the flashlight bulb lens, said second section being a channel in said wall extending in a plane normal to the slot.

2. The tail cap for a flashlight of claim 1, the slot extending through the perimeter wall at each end of the slot.

3. The tail cap for a flashlight of claim 1, the seal being a one-way seal allowing flow from the threads across the seal.

4. A tail cap for a flashlight, comprising:

a flashlight bulb;

a bulb holder including a cylindrical resilient body having a peripheral wall, a slot to receive the flashlight bulb, the slot extending across the resilient body, being sized to receive the flashlight bulb in interference fit and being defined by a wall substantially U-shaped in cross section, the body having ribs extending in substantially parallel planes outwardly of the U-shape wall to and within the peripheral wall;

a cap including an end wall, a cylindrical side wall having a rim and extending from the end wall to the rim with external threads about the rim, and an open cavity defined by the end wall and the side wall, the open cavity sized to receive the bulb holder in interference fit.

5. The tail cap for a flashlight of claim 4, the cap including an annular channel adjacent to the external threads and containing a circular seal.

6. The tail cap for a flashlight of claim 5, the seal being a one-way seal allowing flow from the threads across the seal.

7. A tail cap for a flashlight, comprising:

a flashlight bulb;

a bulb holder including a cylindrical resilient body having a peripheral wall, a slot to receive the flashlight bulb, the slot extending across the resilient body, being sized to receive the flashlight bulb in interference fit and being defined by a wall substantially U-shaped in cross section, the body having ribs extending in substantially parallel planes outwardly of the U-shape wall to and within the peripheral wall;

a cap including an end wall, a cylindrical side wall having a rim and extending from the end wall to the rim, an open cavity defined by the end wall and the side wall, the open cavity sized to receive the bulb holder in interference fit, external threads about the rim, and a spring seat formed at the rim within the cavity.

8. The tail cap for a flashlight of claim 7, further comprising a contact spring positioned in the spring seat and extending from the rim.

* * * * *